US005553779A

United States Patent [19]

Fuller et al.

[11] Patent Number: 5,553,779

[45] Date of Patent: Sep. 10, 1996

[54] AIR POWERED WATER DISPLAY NOZZLE UNIT

[75] Inventors: Mark Fuller, Studio City; Alan Robinson, El Monte, both of Calif.

[73] Assignee: Wet Design, Universal City, Calif.

[21] Appl. No.: 502,369

[22] Filed: Jul. 14, 1995

Related U.S. Application Data

[63] Continuation of Ser. No. 179,981, Jan. 10, 1994, Pat. No. 5,480,094.

[51] Int. Cl.[6] ..... B05B 17/08

[52] U.S. Cl. ..... 239/17; 239/12; 239/99

[58] Field of Search ..... 239/12, 1, 16–18, 239/22, 99; 261/77, 64.1; 4/492, 496

[56] References Cited

U.S. PATENT DOCUMENTS

| | | | |
|---|---|---|---|
| 3,077,306 | 2/1963 | Herzog | 239/17 |
| 3,633,822 | 1/1972 | Hruby, Jr. | 239/17 |
| 4,094,464 | 6/1978 | Kawamura et al. | 239/17 |
| 4,591,094 | 5/1986 | Morris | 239/17 |
| 4,752,421 | 6/1988 | Makino | 261/72 |
| 4,852,801 | 8/1989 | Fuller et al. | 239/12 |
| 4,978,066 | 12/1990 | Fuller et al. | 239/12 |
| 5,028,005 | 7/1991 | Van Diest | 239/205 |

FOREIGN PATENT DOCUMENTS

| | | | |
|---|---|---|---|
| 5-184997 | 7/1993 | Japan | 239/16 |

*Primary Examiner*—Andres Kashnikow
*Assistant Examiner*—Lesley D. Morris
*Attorney, Agent, or Firm*—Blakely, Sokoloff, Taylor & Zafman

[57] ABSTRACT

An air powered water display nozzle unit which has an adjustable nozzle coupled to a housing by a support plate and a plurality of springs.

7 Claims, 2 Drawing Sheets

AIR POWERED WATER DISPLAY NOZZLE UNIT

BACKGROUND OF THE INVENTION

1. Field of the Invention

The present invention relates to an air powered water display nozzle unit that can project water from a pool and is a continuation of Ser. No. 08/179,981, now U.S. Pat. No. 5,480,094, filed Jan. 1, 1994.

2. Description of Related Art

Water fountains and water displays are frequently constructed to improve the aesthetics of a building or a park. Some water fountains are constructed to provide the constant relaxing sound of running water. Other water displays are provided to entertain or amuse the viewer. Exotic or sophisticated water displays are particularly captivating to an audience.

U.S. Pat. Nos. 4,852,801 and 4,978,066 issued to Fuller, et al disclose water displays that include a number of nozzle units located in a pool of water. Each nozzle unit is coupled into a source of pressurized air by a computer controlled solenoid control valve. The introduction of pressurized air to the nozzle unit pushes the water within the nozzle out of the pool and into the ambient. The force of the pressurized air projects the water from the nozzle in a slug like manner. The computer can intermittently open different solenoids to create various water displays. The result is a number of streams or slugs of water that are projected in a vertical direction from the pool.

Each nozzle of the Fuller air powered water display systems has a one way flapper valve which allows water to flow into the nozzle units while preventing pressurized air from escaping the nozzles. The constant opening and closing of the flapper valves creates fatigue and ultimately the failure of the valve. It would therefore be desirable to provide an air powered water display nozzle unit that does not require a one-way flapper valve to introduce water into the nozzle.

The nozzle units are typically over 12 inches long and have a number of hoses that are plumbed into the nozzles. The nozzles and hoses are unsightly and subject to damage. It is therefore desirable to place a slab, also known as a paver, over the nozzle units. The paver has apertures aligned with the nozzles to allow the water to be projected from the pool. In addition to concealing the unsightly nozzles and hoses, the paver also hides the source of the water slugs, thereby providing an element of surprise to the viewer.

It is desirable to project the water slugs in an entirely vertical direction. A slug with a horizontal vector may fall outside of the pool and onto a viewer. For this reason it is preferable to construct the nozzle units so that the tip of the nozzle is essentially perpendicular with the surface of the water. Insuring the perpendicularity of the water surface and the nozzle increases the assembly time and cost of installing the system. It would therefore be desirable to have a nozzle unit which is easy to install and would be properly aligned within a paver of the pool. It would also be desirable to have an air powered nozzle unit which can be mounted to existing pool structures.

SUMMARY OF THE INVENTION

The present invention is an air powered water display nozzle unit which has an adjustable nozzle. The unit includes a housing which can be mounted to the bottom of a pool structure. The housing supports a nozzle which has a positioning plate that is pressed against the bottom of a paver. The paver has an aperture which provides clearance for slugs of water that can be projected by the nozzle from the pool. The nozzle is coupled to the housing by a support plate and a plurality of springs. The plate and springs allow the nozzle to move relative to the housing in either a lateral or vertical direction. The positioning plate orients the nozzle so that the tip is essentially perpendicular to the paver and the pool. The springs allow the nozzle to tilt relative to the housing to compensate for a lack of parallelism between the paver and the pool bottom, and for tolerances in the overall unit.

The nozzle unit is coupled to a source of pressurized air through a computer controlled solenoid control valve that controls the flow of air into the inner chamber of the nozzle. The introduction of pressurized air into the nozzle pushes the water within the inner chamber out of the pool and into the air. Water is drawn back into the inner chamber through an eductor located at the base of the nozzle. The air is introduced to the inner chamber by a feeder tube which has a size, length and location within the nozzle, such that the inertia of the water and the impedance of the nozzle confine the air beneath the water within the nozzle, and the display unit projects the water in a slug-like form.

It is therefore an object of the present invention to provide an air powered water display nozzle unit that has an adjustable nozzle.

It is also an object of the present invention to provide an air powered water display nozzle unit that does not require a one-way flapper valve.

It is also an object of the present invention to provide an air powered water display nozzle unit which can be installed into existing pool structures.

BRIEF DESCRIPTION OF THE DRAWINGS

The objects and advantages of the present invention will become more readily apparent to those ordinarily skilled in the art after reviewing the following detailed description and accompanying drawings, wherein.

DETAILED DESCRIPTION OF THE INVENTION

Figure 1:
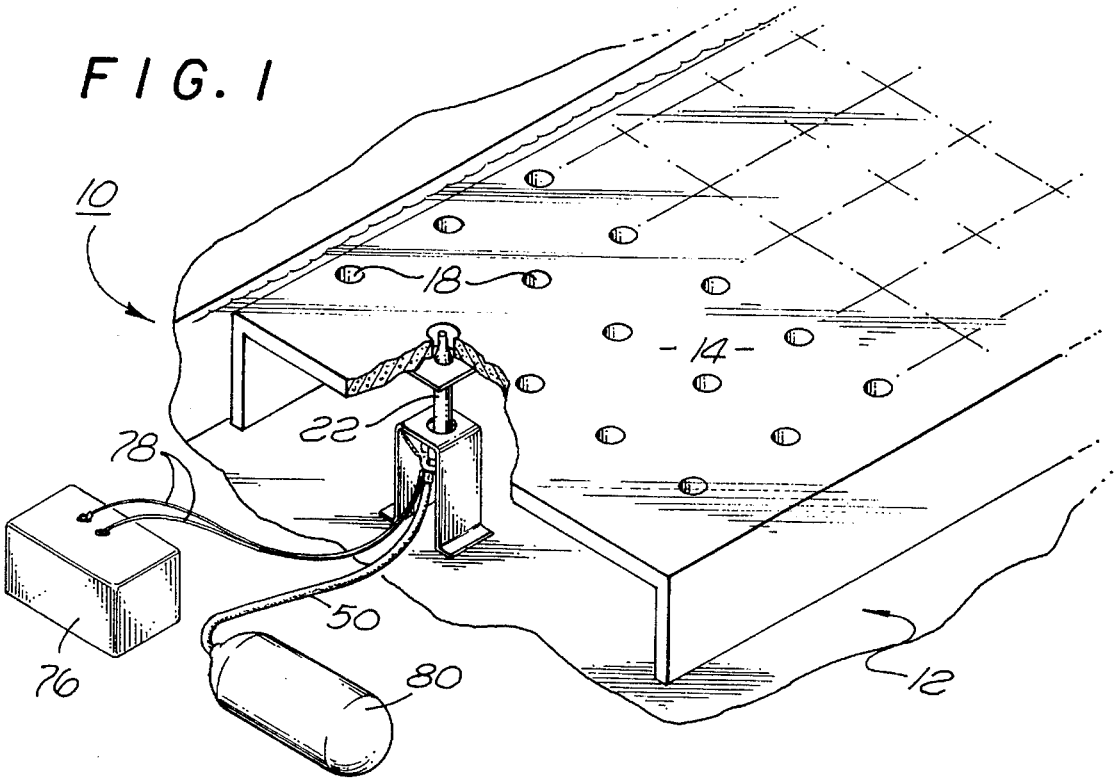
FIG. 1 as a perspective view of a nozzle unit located between a paver and the bottom of a pool.
Figure 2:
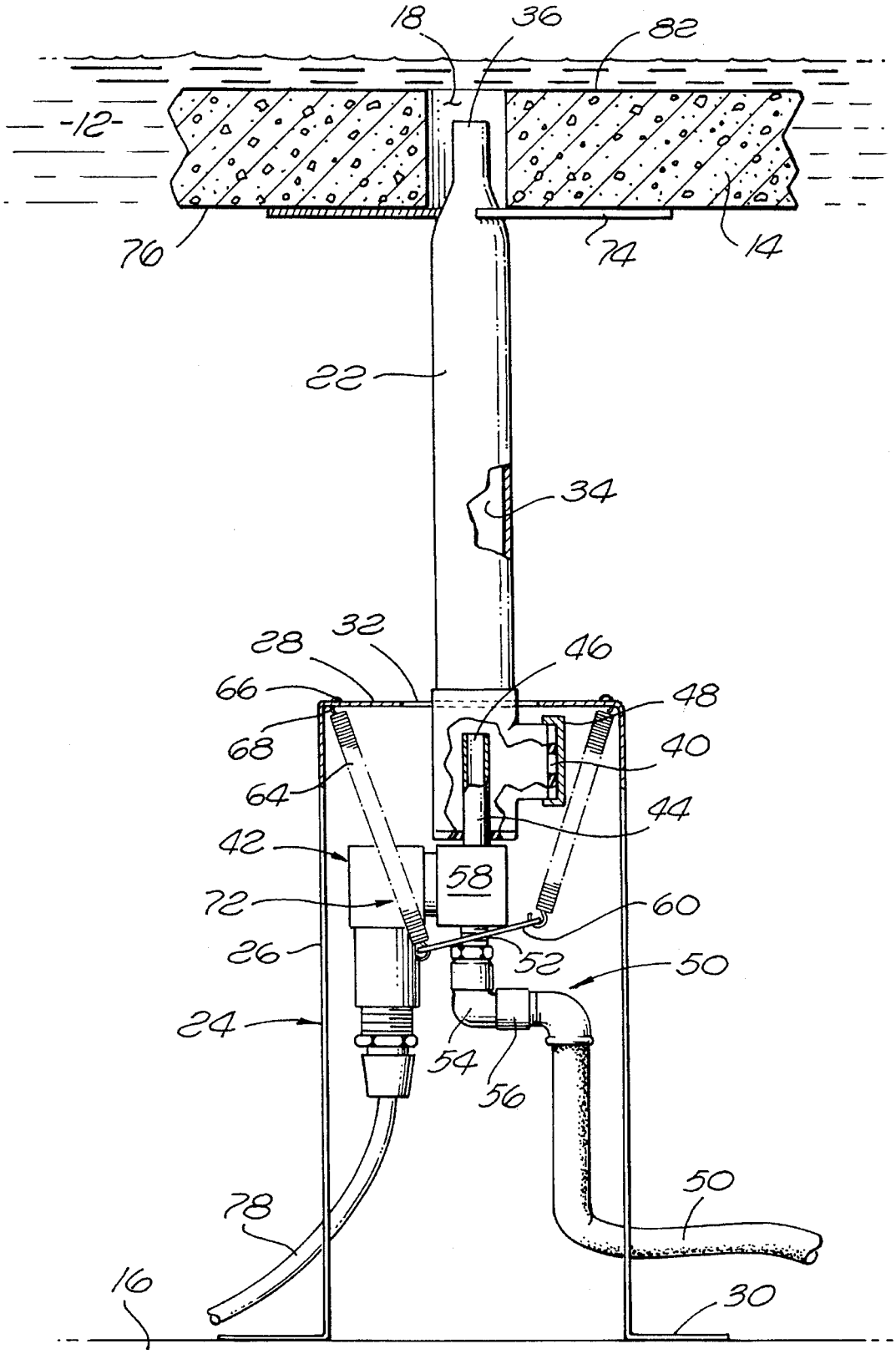
FIG. 2 is a side view of a nozzle unit.

Referring to the drawings more particularly by reference numbers, FIGS. 1 and 2 show an air powered water display system 10 of the present invention. The system 10 is typically located within a pool 12 of water. Although water is described, it is to be understood that the pool 12 may contain any type of fluid. The pool 12 is typically filled with a volume of water sufficient to operate the water display 10.

The system 10 may include a paver 14 located a predetermined distance from the bottom surface 16 of the pool 12. The paver 14 is typically constructed as a rigid slab which has a plurality of apertures 18. For a pool of significant size, the paver 14 can be assembled as a number of individual slabs that are joined together and supported by support means above the bottom surface of the pool. The paver 14 may be constructed from concrete, stone, acrylic or any other suitable material.

Located below each slab aperture 18 is a nozzle unit 20. The nozzle units 20 are capable of projecting a slug of water through the aperture 18 and out of the pool 12. Each unit 20 has a nozzle 22 and a housing 24 mounted to the bottom surface 16 of the pool. The housing 24 preferably has a pair of walls 26 that extend from a top plate 28. Extending from the bottom of the walls 26 are a pair of feet 30 that stabilize the unit 20. The feet 30 are mounted to the pool surface 16, typically by an adhesive such as a silicone seal. Bonding the housing 24 to the bottom surface 16 allows the unit 20 to be installed into a pool 12 without penetrating the concrete or disturbing the waterproof protective seal of the pool 12. The nozzle units 20 of the present invention can thus be installed into existing pool structures.

The top plate 28 of the housing 24 has an opening 32 that provides clearance for the nozzle 22. The nozzle 22 extends from the housing 24 to the aperture 18 of the paver 14 and has an inner chamber 34 which contains a volume of fluid. One end of the nozzle 22 has a tip 36 that typically extends into the aperture 18. The tip 36 has a diameter which is typically smaller than the body of the nozzle, so that a high velocity stream of water is emitted by the unit 20. In the preferred embodiment, the nozzle 22 is constructed from a 1 inch diameter copper tube that is necked to a tip diameter of 0.625 inches. The distance from the base of the tube to the end of the tip is preferably 12 inches in length. It has been found that such dimensions provide a nozzle 22 that contains an amount of water adequate to create a slug of water when projected from the unit 20. The housing 24 is typically constructed as a stamped sheet of metal. In the preferred embodiment, the housing 24 is approximately 13 inches long, with 2 inch wide feet 30 and a top plate 28 that is 6 inches wide. The opening 32 is preferably 2.5 inches in diameter.

The base of the tube 22 is connected to a T pipe fitting 38 which has an opening 40 that allows fluid communication between the pool 12 and the inner chamber 34 of the nozzle 22. The opening 40 is preferably a Venturi-type device commonly referred to as an eductor. The Venturi effect of the eductor draws water into the inner chamber 34 as the air is blowing the water slug out of the tube 22. The eductor has been found to quickly fill the tube so that slugs can be rapidly fired from the nozzle. The T fitting 38 is coupled to a solenoid valve 42 by a feeder tube 44. As shown in FIG. 2, the outlet 46 of the tube 44 is located above the top of the opening 40 to insure that the air is directed up the inner chamber 34 and not through the opening 40. The T fitting 38 typically contains a cover 48 which has a plurality of openings that allow the nozzle 22 to recharge with water.

The inlet of the solenoid valve 42 is coupled to an air supply hose 50 by the male nipple 52 of an elbow 54. The hose 50 is connected to the elbow 54 by a 90° swivel joint 56. The hose 50 is preferably constructed from a flexible material that can be routed throughout the bottom of the pool 12. The body 58 of the solenoid valve 42 rests on a support plate 60 which has an opening 62 that provides clearance for the nipple 52 of the elbow 54. The support plate 60 is coupled to the housing 24 by four springs 64. The springs 64 each have hooked ends 66 that extend through spring apertures 68 and 70 in the support plate 60 and the housing 24, respectively. In the preferred embodiment, the springs 64 are 5 inches long and have an outer diameter of 0.25 inches. As an alternate embodiment, the four separate springs may be replaced by one spring coupled to the housing and the tube.

The springs 64 and support plate 60 form a chassis assembly 72 which allows the nozzle 22 to move relative to the housing 24 in either a vertical or a lateral direction. The unit 20 has a positioning plate 74 located adjacent to the tip 36. The plate 74 is pushed onto the bottom surface 76 of the paver 14 by the springs 64. The positioning plate 74 orients the tip 36 relative to the aperture 18 so that the nozzle 22 is essentially perpendicular to the paver 14 and the water is projected with primarily a vertical velocity vector. In the preferred embodiment, the positioning plate 74 is an 8 inch square brass plate soldered to the neck of the tube 22.

Referring to FIG. 1, the solenoid valves 42 are connected to a computer 76 by a plurality of wires 78. Additionally, the flexible hoses 50 are connected to a source of pressurized air 80. The hoses 50 may be coupled to the air source 80 by a manifold (not shown) or a number of manifolds that have separate control valves (not shown) which vary the air pressure within each set of corresponding nozzle units.

The computer 76 typically provides a control voltage to each of the solenoid valves 42. Energizing the solenoids opens the valves 42 and allows the pressurized air to enter the nozzles 22. The air pressure pushes the water within the inner chamber 36 through the tip 36 and out of the pool 12. The air pressure is typically of a sufficient pressure to maintain a significant amount of separation between the air and the fluid, so that most of the water is pushed out of the nozzle 22. The solenoid valves 42 are preferably two way valves that either allow air to enter the nozzle 22, or prevent air from entering the nozzle 22. The valves 42 may be coupled to a manifold (not shown) that is controlled by a proportional flow control valve (not shown), such that the pressure of the air provided to the valves 42 corresponds to the amplitude of the analog signal. With a proportional flow control valve the computer 76 can program the nozzles 22 to create water slugs that are projected to varying heights. The computer 76 can be programmed to open various solenoids at different times to create a multitude of water patterns. The water patterns may correspond to music or colors.

The system 10 is typically installed by first connecting the solenoids 42 to the computer 76 and the flexible hoses 50 to the air supply 80. The nozzles 22 are inserted through the opening of the housing 24 and the feet 30 of the housing are then mounted to the floor of the pool. The paver 14 is then assembled and installed into the pool 12. The paver 14 is assembled to be essentially level with the top surface of the water in the pool.

Figure 3:
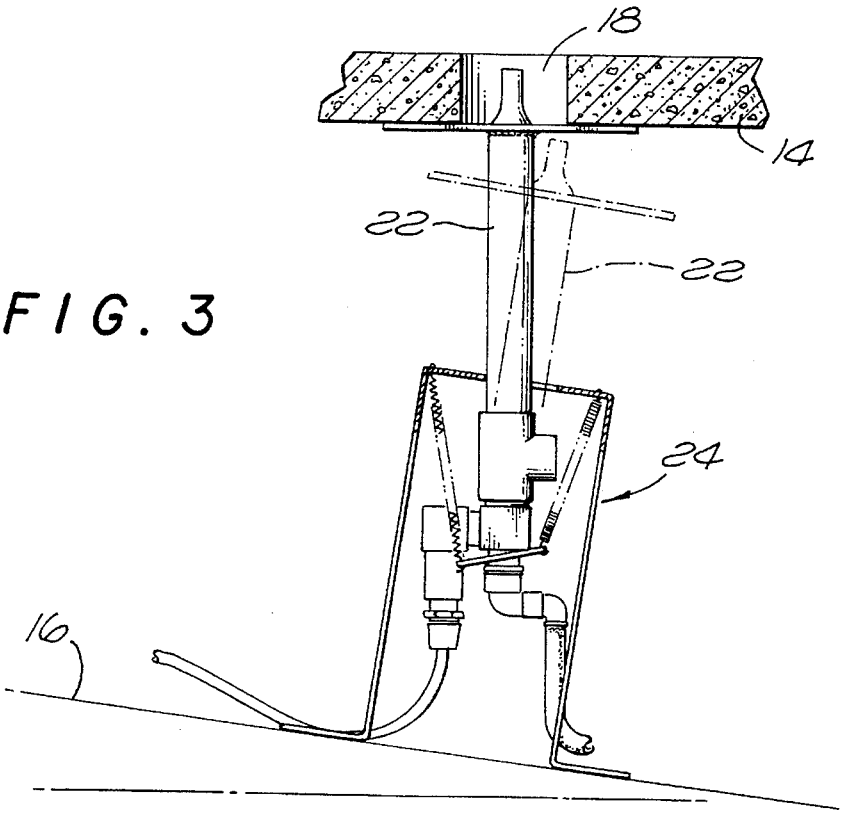
FIG. 3 is a schematic of the nozzle unit showing the nozzle installed into the pool.

As shown in FIG. 3, the paver 14 is assembled so that the nozzle 22 is deflected toward the bottom of the pool 12. The springs 64 provide a counteractive force that pushes the positioning plate 74 against the bottom surface of the paver 14. The engagement of the plate 74 with the paver 14 provides a nozzle 22 that is essentially perpendicular to the surface of the water. The perpendicular orientation of the nozzle 22 creates a system that projects the water slugs in an essentially vertical direction. The chassis system allows the nozzle 22 to float within the housing 24 so that the nozzle 22 is perpendicular to the paver 14. The floating feature of the unit also allows the installation crew to move the tip 36 to the center of the aperture 18 in the event that an error occurs in the installation of the system.

As shown in FIG. 2, the pool 12 is typically filled with water to a level above a top surface 82 of the paver 14. In the preferred embodiment, the water is kept to a level no greater than 0.25 inches from the top surface 82 of the paver 14, so that the pool water does not appreciably effect the projection of the slug. The top surface 82 can be constructed to be black, which together with the naturally reflective surface of water may provide the appearance of a very deep body of water. The black surface will also further camouflage the apertures 18, thereby adding to the mystery of the source of the water slug. As an alternative embodiment, the water level may be maintained below the top surface 82, so that pedestrians can walk on the paver 14. The paver 14 may have pressure sensors that are coupled to the computer 76. Upon the detection of a pedestrian the computer 76 may initiate the projection of a water slug in front of the viewer, thereby adding an element of surprise to the water display.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. An air powered water display nozzle unit that is located within a reservoir of fluid and connected to a source of pressurized air, comprising:

a housing that is located within the reservoir;

a nozzle that is coupled to the source of pressurized air, said nozzle having an eductor opening that provides continuous fluid communication between an inner chamber of said nozzle and the fluid of the reservoirs, said opening allows fluid to flow into said inner chamber from the reservoir when the pressurized air pushes a volume of fluid out of said inner chamber;

a valve that controls the introduction of pressurized air into said inner chamber of said nozzle; and, an air tube coupled to said valve so that said air tube introduces the pressurized air to said inner chamber of said nozzle to eject the volume of fluid from said nozzle, said air tube having an opening located adjacent to said eductor opening so that the air does not flow back through said eductor opening when the pressurized air is introduced to said inner chamber.

2. The nozzle unit as recited in claim 1, further comprising a spring coupled to said housing and said nozzle.

3. The nozzle unit as recited in claim 1, further comprising a plurality of springs that are connected to said housing and to a support plate which supports said nozzle.

4. The nozzle unit as recited in claim 1, wherein said nozzle includes a feeder tube that extends into said inner chamber.

5. The nozzle unit as recited in claim 1, wherein said valve includes a solenoid valve.

6. The nozzle unit as recited in claim 5, further comprising a controller that controls said solenoid valve.

7. The nozzle unit as recited in claim 1, further comprising a positioning plate attached to an end of said nozzle opposite from said valve.

* * * * *

UNITED STATES PATENT AND TRADEMARK OFFICE

CERTIFICATE OF CORRECTION

PATENT NO 5,553,779

DATED September 10, 1996

INVENTOR(S) Fuller et al

It is certified that error appears in the above-identified patent and that said Letters Patent is hereby corrected as shown below In column 1 at line 10, please delete " Jan 1, 1994 " and insert -- Jan 10, 1994 --

In column 1 at line 20, please delete " et al " and insert -- et al --

Signed and Sealed this

Third Day of February, 1998

*Attest:*

*Attesting Officer*

BRUCE LEHMAN

*Commissioner of Patents and Trademarks*

UNITED STATES PATENT AND TRADEMARK OFFICE

CERTIFICATE OF CORRECTION

PATENT NO. : 5,553,779

DATED : September 10, 1996

INVENTOR(S) : Fuller et al.

It is certified that error appears in the above-identified patent and that said Letters Patent is hereby corrected as shown below:

On the title page, please delete "[73] Assignee: Wet Design, Universal City, Calif.".

Signed and Sealed this

Third Day of November, 1998

*Attest:*

*Attesting Officer*

BRUCE LEHMAN

*Commissioner of Patents and Trademarks*

UNITED STATES PATENT AND TRADEMARK OFFICE

CERTIFICATE OF CORRECTION

PATENT NO. : 5,553,779

DATED : September 10, 1996

INVENTOR(S) : Fuller et al.

It is certified that error appears in the above-identified patent and that said Letters Patent is hereby corrected as shown below:

In column 4, line 21, delete "inner chamber 36" and insert -- inner chamber 34 --.

In column 5, claim 1, line 25, delete "reservoirs" and insert -- reservoir --.

In the title page and in sheet 2 of the drawings, please delete Fig. 2 and substitute the amended Fig. 2 as shown below:

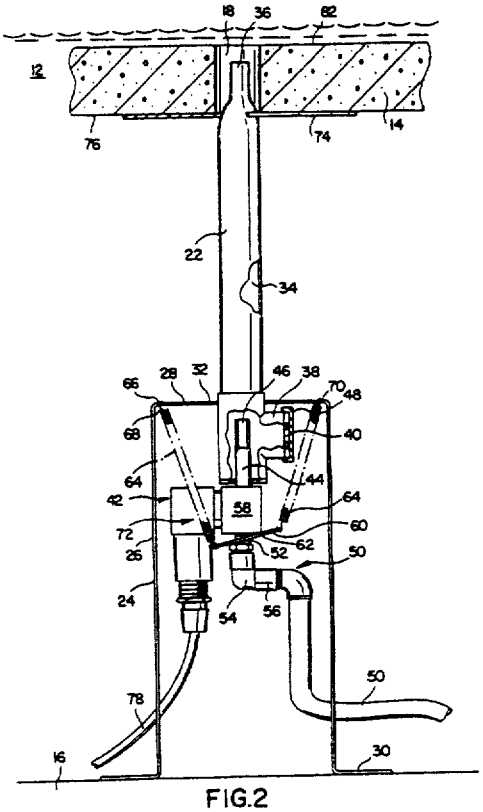

FIG.2

UNITED STATES PATENT AND TRADEMARK OFFICE

CERTIFICATE OF CORRECTION

PATENT NO. : 5,553,779

DATED : September 10, 1996

INVENTOR(S) : Fuller et al.

It is certified that error appears in the above-identified patent and that said Letters Patent is hereby corrected as shown below:

In sheet 1 of the drawings, please delete Fig. 1 and substitute the amended Fig. 1 as shown below:

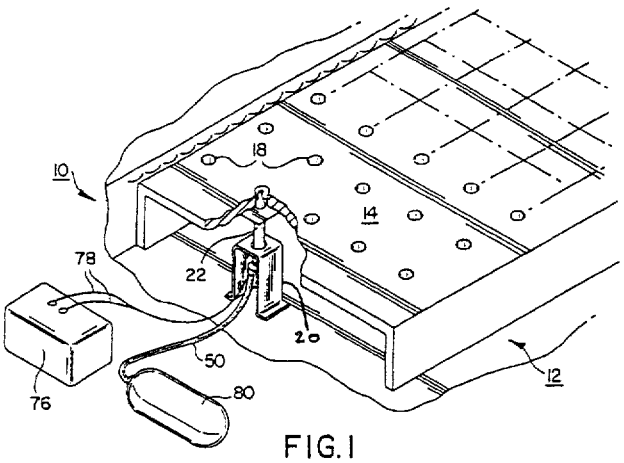

FIG. 1

UNITED STATES PATENT AND TRADEMARK OFFICE

CERTIFICATE OF CORRECTION

PATENT NO. : 5,553,779

DATED : September 10, 1996

INVENTOR(S) : Fuller et al.

It is certified that error appears in the above-identified patent and that said Letters Patent is hereby corrected as shown below:

In sheet 1 of the drawings, please delete Fig. 3 and substitute the amended Fig. 3 as shown below:

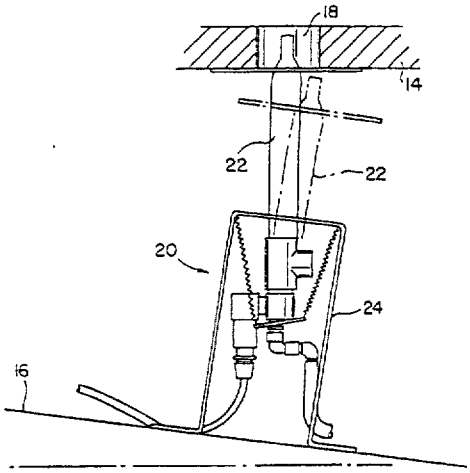

FIG.3

Signed and Sealed this

Twenty-seventh Day of June, 2000

*Attest:*

Q. TODD DICKINSON

*Attesting Officer*

*Director of Patents and Trademarks*